US007447453B2

(12) United States Patent
Kim et al.

(10) Patent No.: US 7,447,453 B2
(45) Date of Patent: Nov. 4, 2008

(54) APPARATUS AND METHOD OF DRIVING A TRANSFER BELT

(75) Inventors: Yong-geun Kim, Suwon-si (KR); Cheol-ju Yang, Daegu (KR); Su-kyoung Chae, Seoul (KR); Moon-bae Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 109 days.

(21) Appl. No.: 10/921,337

(22) Filed: Aug. 19, 2004

(65) Prior Publication Data

US 2005/0089351 A1 Apr. 28, 2005

(30) Foreign Application Priority Data

Oct. 28, 2003 (KR) ..... 10-2003-0075405

(51) Int. Cl.
*G03G 15/16* (2006.01)

(52) U.S. Cl. ..... 399/66; 399/70; 399/302; 399/308; 399/43

(58) Field of Classification Search ..... 399/43, 399/302, 303, 307, 308
See application file for complete search history.

(56) References Cited

U.S. PATENT DOCUMENTS

| | | | | |
|---|---|---|---|---|
| 5,778,292 | A * | 7/1998 | Arends et al. | 399/307 |
| 5,799,228 | A * | 8/1998 | Iwata et al. | 399/43 |
| 6,256,461 | B1 * | 7/2001 | Takeyama et al. | 399/308 |

FOREIGN PATENT DOCUMENTS

| | | |
|---|---|---|
| JP | 04-029277 | 1/1992 |
| JP | 04-125640 | 4/1992 |
| JP | 10-115973 | 5/1998 |
| KR | 000009242 | 2/2000 |
| KR | 2003-0039173 | 5/2003 |

* cited by examiner

*Primary Examiner*—David M. Gray
*Assistant Examiner*—Laura K Roth
(74) *Attorney, Agent, or Firm*—Roylance, Abrams, Berdo & Goodman, L.L.P.

(57) ABSTRACT

An apparatus and method of driving a transfer belt are disclosed. The apparatus and method comprise driving the transfer belt provided in an image forming apparatus by a predetermined distance when the transfer belt has been stopped for a predetermined time, and thus varying the contact portion with a plurality of rollers provided on the transfer belt. Image contamination due to deformation on the belt can be avoided. Additionally, because the rotation time of the driving source can be set to a predetermined time during the power-saving mode, power consumption can be minimized.

9 Claims, 4 Drawing Sheets

APPARATUS AND METHOD OF DRIVING A TRANSFER BELT

This application claims the benefit under 35 U.S.C. § 119 (a) of Korean Patent Application No. 2003-75405, filed on Oct. 28, 2003, the entire contents of which is incorporated herein by reference.

BACKGROUND OF THE INVENTION

1. Field of the Invention

The present invention relates to an apparatus and method of driving a transfer belt. More particularly, the present invention relates to an apparatus and method of driving a transfer belt on a standby mode or a power-saving mode to prevent deformation of the transfer belt.

2. Description of the Related Art

Image forming apparatuses, such as printers and photocopiers, generally include a photoconductive unit having a photosensitive medium on which an image is developed, and a transfer unit which transfers the developed image onto a transfer medium such as paper. The transfer unit has a transfer belt which runs along a continuous track.

FIG. 1 shows an image forming apparatus which employs the transfer unit having the transfer belt as described above. Reference character 'P' indicates a paper conveyance path.

As shown in FIG. 1, an image forming apparatus 30 includes a photoconductive unit 10 having a photosensitive medium 11 such as an OPC drum, a laser scanning unit 12, a developing device 13, a transfer unit 20 having a transfer belt 14, a plurality of rollers for moving the transfer belt 14 along a continuous track, and a fusing roller 21 for fusing an image. The plurality of rollers include a first transfer roller 16 which transfers an image onto the transfer belt 14, a second transfer roller 19 which transfers the image onto the transfer medium such as paper, a tension roller 18 which adjusts a tension of the transfer belt 14, a nip roller 17, and a backup supporting roller 15 which idle-rotates in association with the rotation of the second transfer roller 19. All the parts mentioned above are operated in conjunction with one another and perform a series of processes in the following sequential order: electrical charging, laser-scanning, developing, transferring and fusing, to form a desired image.

FIG. 2 is a flowchart showing a method of driving the transfer belt as shown in FIG. 1. The method of driving the transfer belt is described below.

First, the image forming apparatus 30 is in a home mode, in which the image forming apparatus 30 is in a power-on state and is supplied with power, or has finished printing at step S9. During the printing operation, the transfer belt 14 comes into contact with the photosensitive medium 11 and the transferring medium to transfer the image formed on the photosensitive medium 11 to the transferring medium.

It is determined whether a work signal is input in the image forming apparatus 30 at step S10. The presence or absence of the work signal is determined by a controller 31 which is disposed in the image forming apparatus. If a work signal is input, the printing operation starts according to the work signal at step S11.

If the work signal is not input, the controller 31 enters a standby mode to stop the operation of a driving source 32 such as a motor of the image forming apparatus at step S12. At step S13, the controller 31 compares a lapse time 'ta' measured from the beginning of the standby mode to a first reference time 't1'. If the lapse time 'ta' is greater than the first reference time 't1', the controller 31 enters into a power-saving mode at step S14.

The power-saving mode prevents power from being supplied to a high power consumption unit such as a heat lamp for heating the fusing roller, to conserve power when the image forming apparatus is in the standby mode for an extended period of time.

In the conventional image forming apparatus 30, the transfer belt 14 does not rotate when the image forming apparatus 30 enters the standby mode or the power-saving mode after the power supply or the print job. Consequently, in the standby mode or the power-saving mode, the transfer belt 14 maintains contact with the plurality of rollers 15, 16, 17, 18, 19 at the same positions. Subsequently, pressure is applied to the same points. When the standby mode or the power-saving mode lasts long, the pressure to the transfer belt 14 becomes greater.

Also, if the pressure is exerted to the contact points between the transfer belt 14 and the plurality of rollers 15, 16, 17, 18, 19 while the image forming apparatus 30 remains at a high temperature such as shortly after the standby mode or the power-saving mode, traces of the plurality of rollers 15, 16, 17, 18, 19 remain on the transfer belt 14 in a stripe pattern, and therefore cause a deformation of the transfer belt 14. Such a deformation is particularly severe in the area where the transfer belt 14 contacts the tension roller 18 and the first transfer roller 16.

The problem worsens as the deformation of the transfer belt causes image blurring during the transfer of the image, and if this happens, a user cannot obtain a clear image.

SUMMARY OF THE INVENTION

The present invention has been developed in order to solve the above drawbacks associated with the conventional arrangement. An aspect of the present invention is to provide an apparatus and method of driving a transfer belt in a standby mode and a power-saving mode to prevent deformation of the transfer belt.

The above aspects and other features of the present invention are substantially accomplished by an apparatus and method for driving a transfer belt. The apparatus and method comprise driving the transfer belt provided in an image forming apparatus by a predetermined distance when the transfer belt has been stopped for a predetermined time, and thus varying the contact points using a plurality of rollers provided on the transfer belt.

The belt driving step further comprises a first driving step for entering a standby mode which is maintained for a predetermined period. The belt driving step further comprises a second driving step for entering a power-saving mode to turn off a high-voltage consuming unit provided the image forming apparatus after the standby mode.

The first driving step comprises comparing a first elapsed time from entering the standby mode to a pre-set first reference time; comparing the first elapsed time with a second reference time if the first elapsed time is less than the first reference time; and if the first elapsed time is greater than or equal to the second reference time, varying the contact points of the transfer belt with the plurality of rollers by driving the transfer belt. Additionally, the power-saving mode begins if the first elapsed time is greater than or equal to the first reference time. The second driving step comprises comparing a second elapsed time from entering the power-saving mode with a third reference time; and if the second elapsed time is greater than or equal to the third reference time, varying the contact points of the transfer belt with the plurality of rollers by moving the transfer belt. The varying step is repeated at least one time with reference to the third reference time.

The varying step comprises counting the number of driving operations of the transfer belt; comparing the counted number with a reference number; and if the counted number is less than the reference number, driving the transfer belt by operating a driving source provided in the image forming apparatus.

After the standby mode which is maintained for a predetermined time, the belt driving step is performed in a power-saving mode to turn off a high-voltage consuming unit in the image forming apparatus.

The belt driving step comprises comparing a first elapsed time from entering the standby mode with a first reference time; if the first elapsed time is greater than or equal to the first reference time, entering the standby mode; and a second driving step is performed in the power-saving mode.

The second driving step comprises comparing a second elapsed time from entering the power-saving mode with a third reference time; and if the second elapsed time is greater than or equal to the third reference time, varying contact points with the plurality of rollers by moving the transfer belt.

The varying step is repeated at least one time with reference to the third reference time.

The varying step comprises counting the number of driving operations of the transfer belt; comparing the counted number with the reference number; and if the counted number is less than the reference number, moving the transfer belt by driving a driving source provided in the image forming apparatus.

BRIEF DESCRIPTION OF THE DRAWINGS

The above aspects and features of the present invention will be more apparent by describing certain embodiments of the present invention with reference to the accompanying drawings, in which.

Throughout the drawings, it should be noted that the same or similar elements are denoted by like reference numerals.

DETAILED DESCRIPTION OF THE PREFERRED EMBODIMENTS

Embodiments of the present invention will be described in greater detail with reference to the accompanying drawings.

Figure 1:
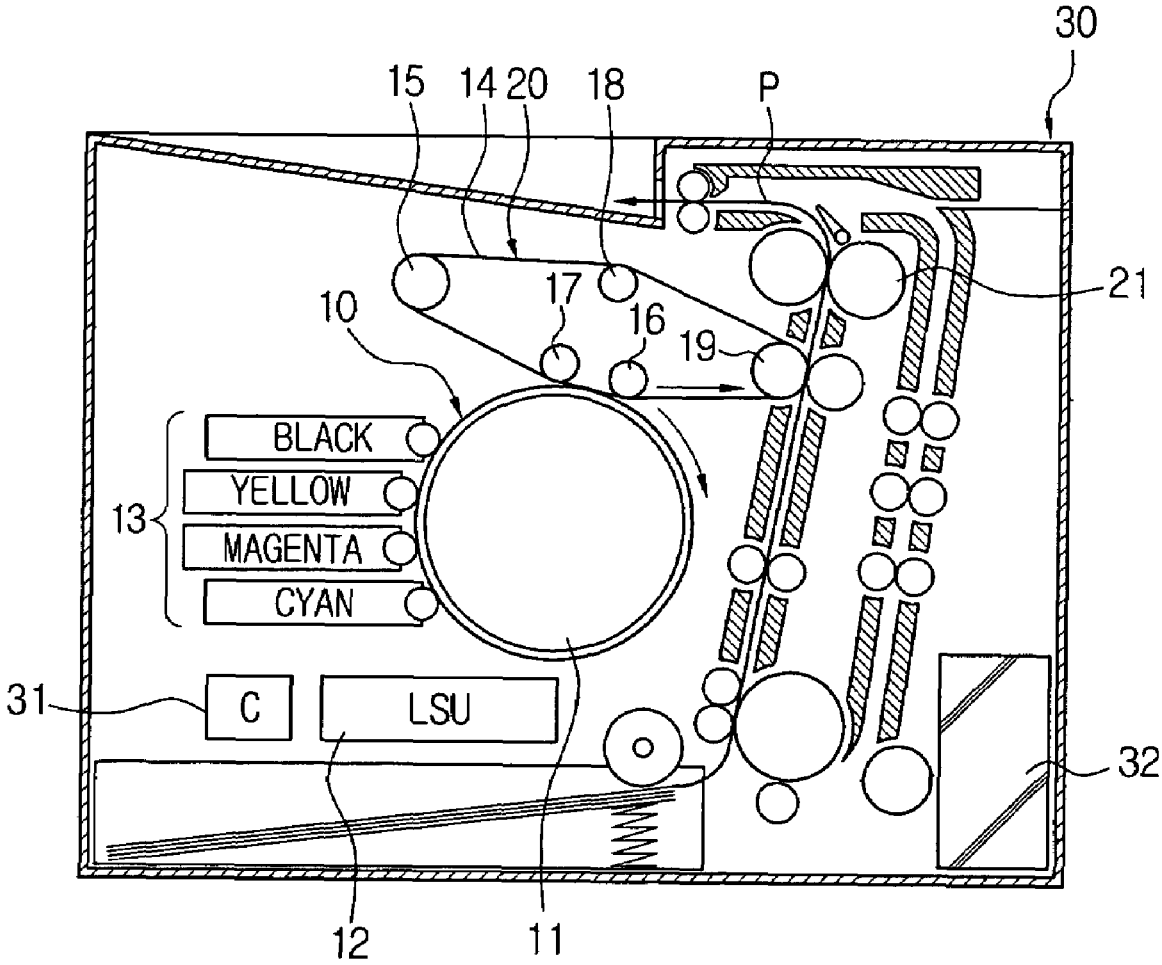
FIG. 1 (PRIOR ART)
FIG. 1 is a diagram illustrating a conventional image forming apparatus.
Figure 2:
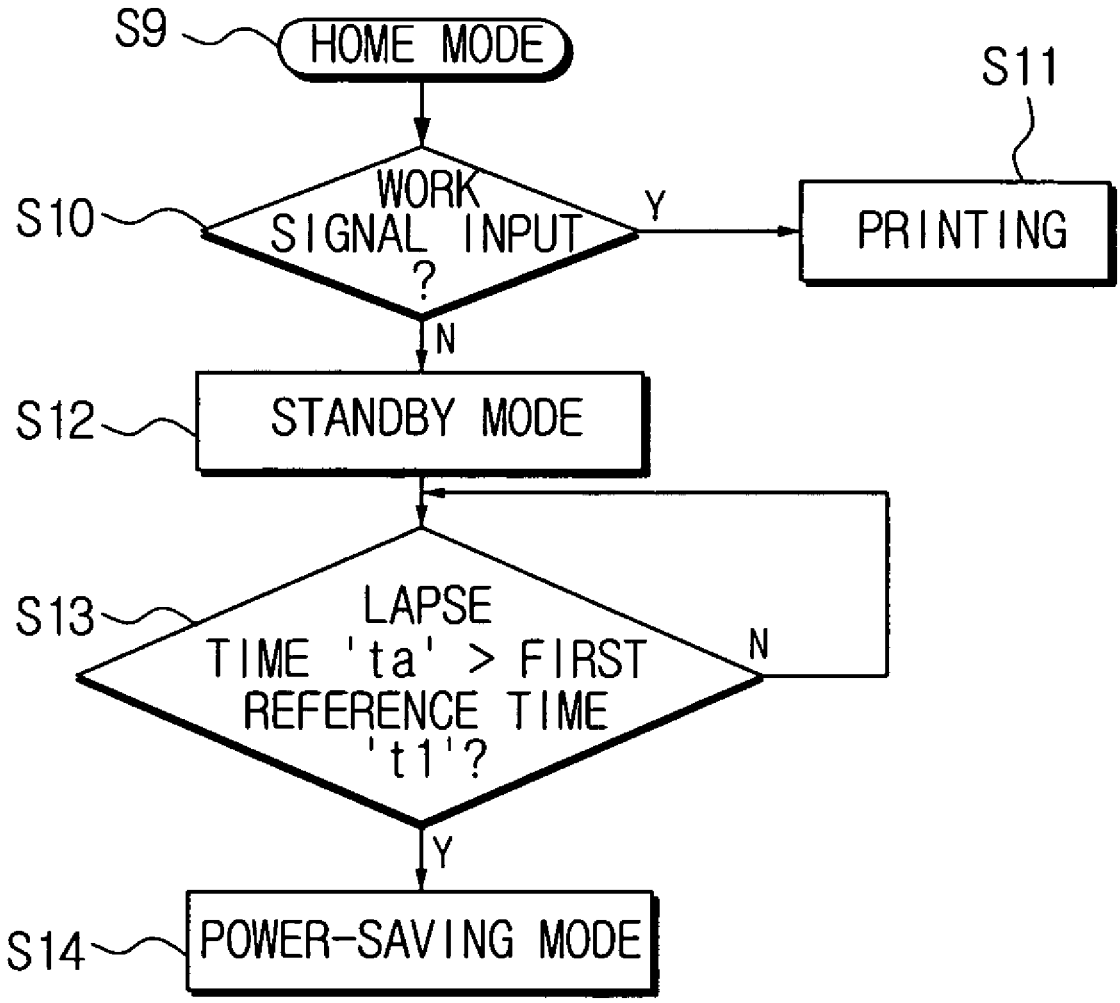
FIG. 2 (PRIOR ART)
FIG. 2 is a flowchart illustrating a method of driving the transfer belt as shown in FIG. 1.
Figure 3:
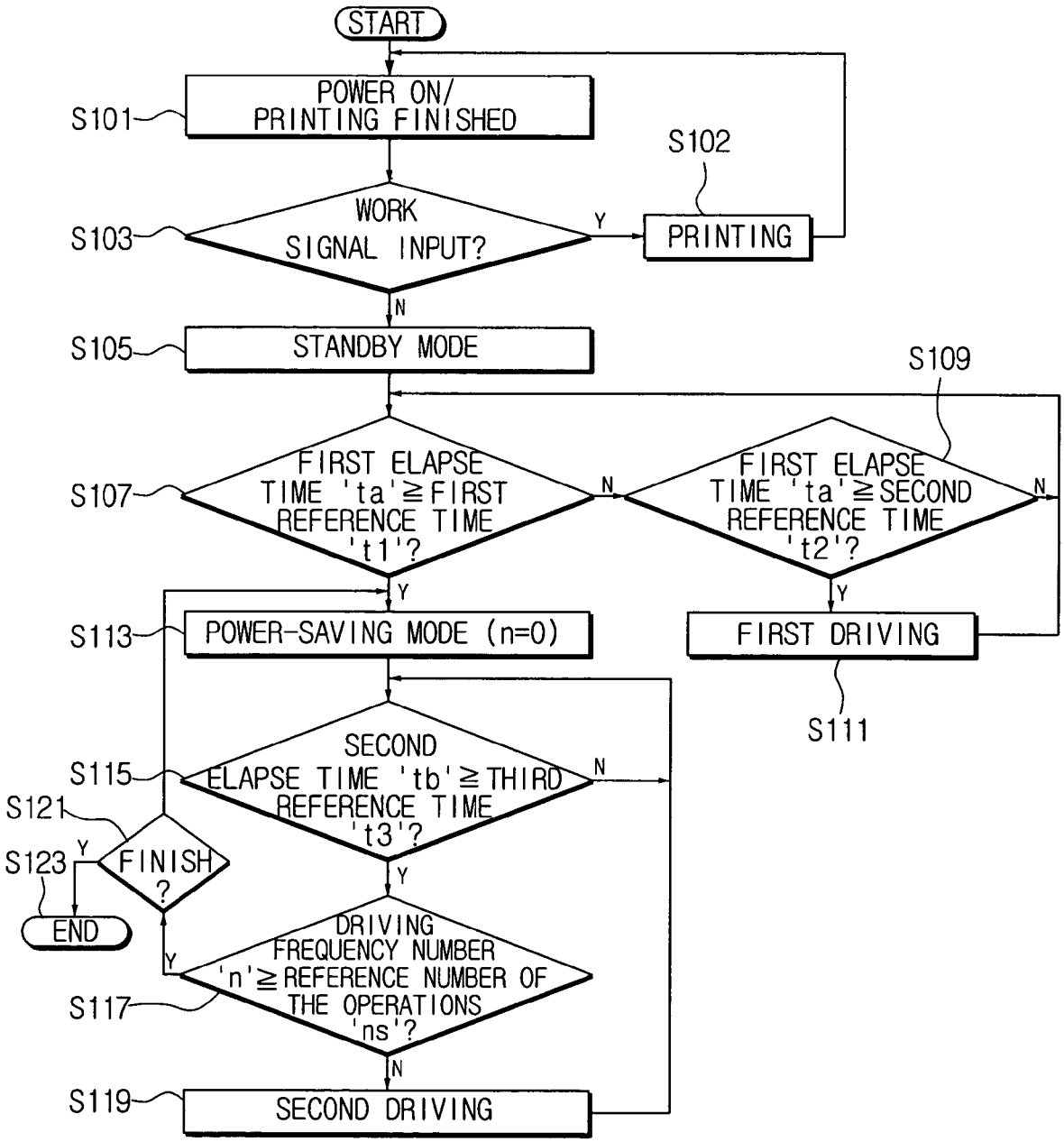
FIG. 3 is a flowchart illustrating a method of driving a transfer belt according to an embodiment of the present invention.

FIG. 3 is a flowchart illustrating a method of driving a transfer belt according to an embodiment of the present invention. The method of FIG. 3 is performed on an apparatus identical or substantially identical to the apparatus of FIG. 1.

Referring to FIG. 3, a method of driving a transfer belt according to an embodiment of the preset invention includes a belt driving step which drives a transfer belt 14 provided in an image forming apparatus by a predetermined distance when the transfer belt 14 has been stopped for a predetermined time, and thus varies contact points between the transfer belt 14 and a plurality of rollers provided on the transfer belt 14. The belt driving step includes a first driving step S111 and a second driving step S119 for driving the transfer belt 14 to prevent the deformation of the transfer belt 14 due to prolonged contact between the transfer belt 14 and a transferring medium.

In a home mode, the image forming apparatus 30 is in a power-on state where power is supplied to the image forming apparatus 30 or is in a printing-finished state at step S101. During the printing job, the transfer belt 14 comes in contact with a photosensitive medium and a transferring medium such as paper, and transfers an image formed on the photosensitive medium 11 to the transferring medium.

Next, it is determined whether a work signal is input into the image forming apparatus 30 at step S103. The presence or absence of the work signal is determined by a controller 31 which is provided in the image forming apparatus 30. If a work signal is input, a printing work is performed according to the work signal at step S102. Steps S103 and S102, for performing printing work depending on the input of work signal, can be inserted in between various steps which will be described below. A detailed description thereof is omitted for conciseness.

If a work signal is not input, the controller 31 enters a standby mode at step S105.

Mode determination is performed at step S107, in which the controller 31 compares a first elapsed time 'ta', which is measured from the beginning of the standby mode, to a first reference time 't1'. The first reference time 't1' is used to determine whether to proceed to a power-saving mode step at step S113. Preferably, the first reference time 't1' can be set as 10 minutes. The reference time 't1' can be variably set according to the condition of the image forming apparatus 30.

If the first elapsed time 'ta' is shorter than the first reference time 't1', a first driving determination step is performed at step S109, in which the first elapsed time 'ta' is compared to a second reference time 't2'. If the first elapsed time 'ta' is greater than or equal to the second reference time 't2', the first driving step begins at step S111.

At step S111, the controller 31 sends a control signal to a driving source 32 to operate the driving source 32. The driven driving source 32 provides a driving force to a second transfer roller 19 of a plurality of rollers 15, 16, 17, 18, 19 to drive the transfer belt 14. At this time, the controller 31 operates the driving source 32 for a certain period of time to move the transfer belt 14 by a predetermined distance. Preferably, the operation time of the driving source 31 is set as 250 milliseconds (ms). The operation time of the driving source 31 can be varied within a range that can change the contact points of the transfer belt 14 with the plurality of rollers 15, 16, 17, 18, 19, especially, the first transfer roller 16 and the tension roller 18 by driving the transfer belt 14.

If the first elapsed time 'ta' is less than the second reference time 't2', the mode determination step S107 is repeated. If the first elapsed time 'ta' is greater than, or equal to the second reference time 't2', the first driving determination step is repeated.

If the first elapsed time 'ta' is greater than, or equal to the first reference time 't1' in the mode determination step S107, the power-saving mode is performed at step S113. At step S113, a power supply to a high voltage-consuming unit of the image forming apparatus such as a heat lamp for supplying heat to the fusing roller is blocked so that power consumption of the image forming apparatus is reduced.

A second driving determination step S115 is performed, in which a second elapse time 'tb', which is measured from the beginning of the power-saving mode at step S113, is compared with a third reference time 't3'. The third reference time 't3' is used to determine whether to drive the transfer belt.

Preferably, the third reference time 't3' can be set to 10 minutes. The third reference time 't3' may be identical to the second reference time 't2', or independently set from each other according to the condition of the image forming apparatus 30 and the transfer belt 14.

If the second elapsed time 'tb' is greater than, or equal to the third reference time 't3' in the second driving determination step S115, a driving number determination step S117 is performed. In one embodiment, an initial counting number 'n' can be set to '0' upon entering into the power-saving mode at step S113. In the driving number determination step S117, the number of driving operations of the driving source 32 is counted. The counted number 'n' is compared to a reference number 'ns', and if the counted number 'n' is less than the reference number 'ns', the second driving step S119 is performed. Preferably, the reference number 'ns' may be set to 2. The reference number 'ns' may be greater than 2, or appropriately set according to various conditions of the transfer belt 14. As a result, the transfer belt 14 is driven after the third reference time 't3', repeatedly.

In the second driving step S119, the controller 31 transmits a control signal to the driving source 32 to operate the driving source 32. The driven driving source 32 provides a driving power to the second transfer roller 19 of the plurality of rollers 15, 16, 17, 18, 19 to drive the transfer belt 14. The controller 31 operates the driving source 32 for a predetermined time to move the transfer belt 14 by a predetermined distance. The operation time of the driving source 31 may be set to 250 ms. Also, the operation time of the driving source may be varied within a range that can change the contact points of the transfer belt 14 with the plurality of rollers 15, 16, 17, 18, 19, especially, the first transfer roller 16 and the tension roller 18 by driving the transfer belt. Further, the operation time of the driving source 31 in the second driving step S119 may be identical to that in the first driving step S111, or differently set according to various conditions of the transfer belt 14 and the image forming apparatus 30. Since the steps following the power saving mode step S113 enable a user to set the operation time and the number of operations of the driving source 32, the transfer belt 14 can be driven when the driving source is driven at a minimum, and the pressure exerted onto the same contact points can be prevented. As a result, power consumption can be reduced.

After the second driving step S119, the counted number n becomes n=n+1 and is stored in a memory (not shown) of the controller 31. The second driving determination step S115 is repeated and followed by the driving number determination step S117. In the driving number determination step S117, if the counted number 'n' is greater than, or equal to the reference number 'ns', a finish determination step S121 is performed.

The finish determination step S121 stops the power saving-mode 113 on receipt of a power-off signal or a work signal from the controller 31, to block power to the image forming apparatus or re-start the printing. The method of driving a transfer belt ends at step S123.

Figure 4:
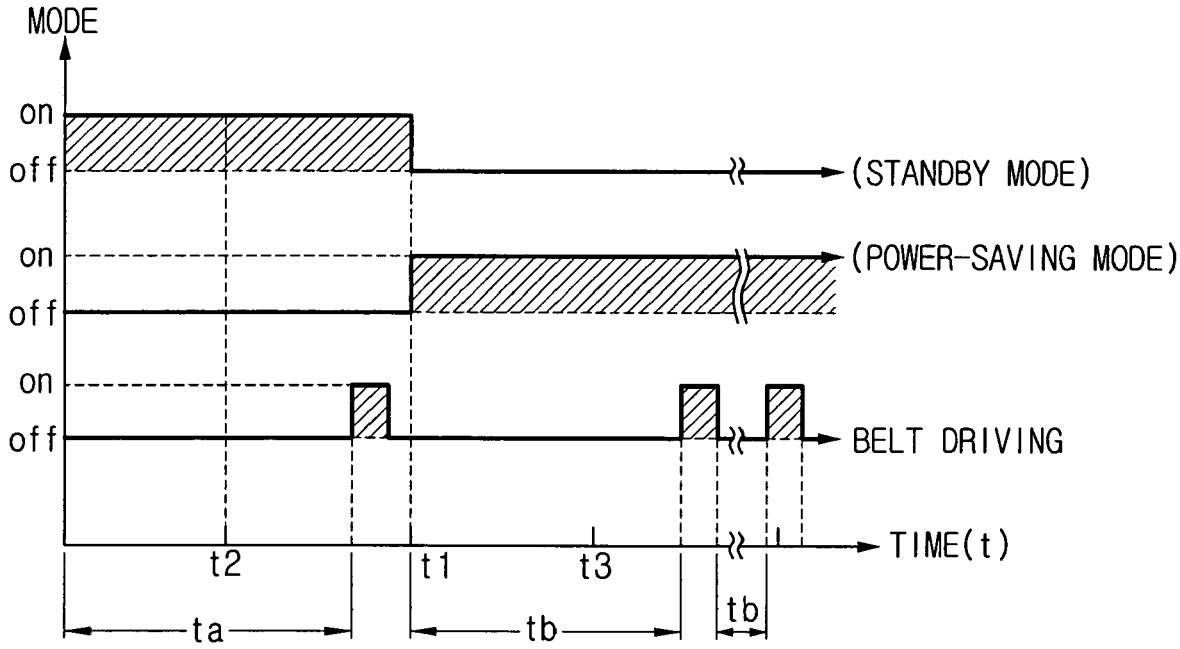
FIG. 4 is a diagram illustrating a condition of the transfer belt according to an embodiment of the present invention, when the transfer belt is operated during the standby mode and the power-saving mode.

Referring now to FIG. 4, driving operation of the transfer belt in the standby mode and the power-saving mode will be described below.

As shown in FIG. 4, in the standby mode S105, when the first elapse time 'ta', which is measured from the beginning of the standby mode S105, is in between the first reference time 't1' and the second reference time 't2', the controller 31 drives the driving source 32 for a predetermined time. In the power saving mode S113, when the second elapse time 'tb' exceeds the third reference time 't3', the controller 31 drives the driving source 32 for a predetermined time to drive the transfer belt 14. The number of the driving operations of the transfer belt 14 is limited being below the reference number 'ns' through the driving number determination step S117. Preferably, the driving source 32 can be driven both in the standby mode S105 and the power saving mode S113. Alternatively, the driving source can be driven either in the standby mode S105 or the power saving mode S113.

The method of driving the transfer belt 14 as described above can prevent the transfer belt 14 from being in continuous contact with the plurality of rollers 15, 16, 17, 18, and 19 at the same points when in the standby mode or the power-saving mode. Accordingly, excessive contact at the same points can be avoided. With the high inner temperature of the image forming apparatus 30 shortly after the standby mode or the power saving mode, it is often the case with the conventional method that the contact points between the transfer belt 14 and the plurality of rollers 15, 16, 17, 18, and 19 are deformed due to pressure. However, as described above in various embodiments of the present invention, such deformation of the belt can be avoided.

Accordingly, a blurring of the printing image due to the deformation of the belt is prevented, and a desired image can be obtained. Also, since the rotation time of the driving source 32 can be set to a predetermined time during the power-saving mode, the power consumption in the power-saving mode can be minimized.

As described above, the method of driving the transfer belt 14 continuously varies the contact points with the plurality of rollers 15, 16, 17, 18, 19, thereby preventing blurring of an image caused by the deformation of the belt. Also, since the rotating time of the driving source 32 can be set to a predetermined time during the power-saving mode, the deformation of the belt can be prevented and also power consumption can be minimized.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A method of driving a transfer belt comprising:

driving a transfer belt provided in an image forming apparatus by a distance when the transfer belt has been stopped for a period of time, whereby contact points with a plurality of rollers provided on the transfer belt are varied, wherein the driving of the transfer belt comprises: a first driving step for entering a standby mode for the time period; and a second driving step for entering a power-saving mode and proceeding according to a reference time and a number of driving operations of the transfer belt set at a power-saving mode to turn off a high-voltage consuming unit of the image forming apparatus after the standby mode;

wherein the second driving step further comprises counting the number of driving operations of the transfer belt;

comparing the counted number with a reference number; and driving the transfer belt by operating a driving source provided in the image forming apparatus if the counted number is less than a reference number.

2. The method as claimed in claim 1, wherein the first driving step comprises the steps of:

comparing a first elapsed time from entering the standby mode with a first reference time;

comparing the first elapsed time with a second reference time if the first elapsed time is less than the first reference time; and varying the contact points of the transfer belt with the plurality of rollers by driving the transfer belt if the first elapsed time is greater than or equal to the second reference time.

3. The method as claimed in claim 2, further comprising the step of entering into the power-saving mode if the first elapsed time is greater than or equal to the first reference time.

4. The method as claimed in claims 1, wherein the second driving step comprises the steps of:

comparing a second elapsed time from entering the power saving mode with a third reference time; and varying the contact points of the transfer belt with the plurality of rollers by moving the transfer belt if the second elapsed time is greater than or equal to the third reference time.

5. The method as claimed in claim 4, wherein the varying step is repeated at least once with reference to the third reference time.

6. The A method of driving a transfer belt comprising:

driving a transfer belt provided in an image forming apparatus by a distance when the transfer belt has been stopped for a period of time, whereby contact points with a plurality of rollers provided on the transfer belt are varied, wherein the driving of the transfer belt comprises:

a first driving step for entering a standby mode for the predetermined time; and a second driving step for entering a power-saving mode to turn off a high-voltage consuming unit provided in the image forming apparatus after the standby mode; and wherein after maintaining the standby mode for a time period, the driving of the transfer belt is accomplished in the power saving mode to turn off a high-voltage consuming unit of the image forming apparatus according to a reference time and a number of driving operations of the transfer belt;

wherein the second driving step further comprises counting the number of driving operations of the transfer belt;

comparing the counted number with the reference number; and moving the transfer belt by driving a driving source provided in the image forming apparatus if the counted number is less than the reference number.

7. The method as claimed in claim 6, wherein the belt driving step comprises the steps of:

comparing a first elapsed time from entering the standby mode with a first reference time;

entering the power-saving mode if the first elapsed time is greater than or equal to the first reference time; and a second driving step being accomplished in a power-saving mode.

8. The method as claimed in claim 7, wherein the belt driving step comprises the steps:

comparing a second elapsed time entering the power-saving mode with a third reference time; and varying the contact points with the plurality of rollers by moving the transfer belt if the second elapsed time is greater than or equal to the third reference time.

9. The method as claimed in claim 8, wherein the varying step is repeated at least one time with reference to the third reference time.

* * * * *